US012781327B2

(12) United States Patent
Unno et al.

(10) Patent No.: US 12,781,327 B2
(45) Date of Patent: Nov. 3, 2026

(54) FERROUS ALLOY FOIL, MANUFACTURING METHOD THEREFOR, AND COMPONENT USING SAME

(71) Applicant: NIPPON STEEL Chemical & Material Co., Ltd., Tokyo (JP)

(72) Inventors: Hiroto Unno, Tokyo (JP); Atsushi Yashiro, Tokyo (JP); Hiroaki Ohara, Tokyo (JP); Ayaka Sawada, Tokyo (JP); Naoki Fujimoto, Tokyo (JP); Naoya Sawaki, Tokyo (JP)

(73) Assignee: NIPPON STEEL CHEMICAL & MATERIAL CO., LTD., Tokyo (JP)

( * ) Notice: Subject to any disclaimer, the term of this patent is extended or adjusted under 35 U.S.C. 154(b) by 454 days.

(21) Appl. No.: 18/561,557

(22) PCT Filed: May 13, 2022

(86) PCT No.: PCT/JP2022/020256
§ 371 (c)(1),
(2) Date: Nov. 16, 2023

(87) PCT Pub. No.: WO2022/244701
PCT Pub. Date: Nov. 24, 2022

(65) Prior Publication Data

US 2024/0254606 A1 Aug. 1, 2024

(30) Foreign Application Priority Data

May 17, 2021 (JP) ..... 2021-083415

(51) Int. Cl.
*C22C 38/52* (2006.01)
*C21D 7/02* (2006.01)
(Continued)

(52) U.S. Cl.
CPC ..... *C22C 38/52* (2013.01); *C21D 7/02* (2013.01); *C21D 7/13* (2013.01); *C22C 38/001* (2013.01);
(Continued)

(58) Field of Classification Search
CPC ..... C22C 38/52; C22C 38/001; C22C 38/002; C22C 38/02; C22C 38/04; C22C 38/06;
(Continued)

(56) References Cited

U.S. PATENT DOCUMENTS 6,187,452 B1 * 2/2001 Muto ..... C22C 38/42 428/606
2002/0006350 A1 1/2002 Nishida et al.
(Continued)

FOREIGN PATENT DOCUMENTS

JP 3-61322 A 3/1991
JP 2000-273586 A 10/2000
(Continued)

*Primary Examiner* — Adil A. Siddiqui
(74) *Attorney, Agent, or Firm* — Birch, Stewart, Kolasch & Birch, LLP

(57) ABSTRACT

The present invention addresses the problem of reducing the cause of etching failure or pinholes as much as possible in an extremely thin ferrous alloy foil that has a thickness of 10-30 μm and that is applied to a metal mask used for increasing the precision of an electronic component. In order to solve the abovementioned problem, the present invention provides a ferrous alloy foil that has a composition containing at most 0.150% of C, at most 2.00% of Si, at most 10.00% of Mn 2.00-50.00% of Ni, at most 19.00% of Cr, at most 0.20% of N, at most 0.030% of Al, at most 5.00% of Co, at most 0.0005% of Mg, at most 0.0005% of Ca, at most 0.01% of Ti, at most 0.035% of P, and at most 0.0300% of S, with the balance consisting of Fe and impurities. The amount of $Al_2O_3$ is at most 30 mass % and the amount of MgO is at most 15 mass % with respect to the total mass of
(Continued)

inclusions having a particle diameter of 2.00 μm or larger, and among the inclusions having a particle diameter of 2.00 μm or larger, the number ratio of inclusions having a particle diameter of no larger than 5.00 μm is 80.00% or higher.

20 Claims, 1 Drawing Sheet

(51) Int. Cl.

| | |
|---|---|
| ***C21D 7/13*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/50*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/50* (2013.01)

(58) Field of Classification Search
CPC ..... C22C 38/50; C22C 38/08; C22C 38/14; C22C 38/34; C22C 38/38; C22C 33/0285; C22C 38/58; C22C 33/02; C21D 7/02; C21D 7/13; C21D 8/02; C21D 8/021; C21D 8/0236; C21D 9/46; C21D 1/30; C21D 2211/001; C21D 8/0226; B22F 3/15; B22F 3/17; B22F 3/18; B22F 3/24; B22F 5/006; B22F 2009/0824; B22F 9/08; B22F 2003/153; B22F 2999/00; B22F 2201/02; B22F 2998/10
See application file for complete search history.

(56) References Cited

U.S. PATENT DOCUMENTS

| | | | |
|---|---|---|---|
| 2018/0272397 | A1 | 9/2018 | Ehara et al. |
| 2021/0102268 | A1 | 4/2021 | Oka et al. |
| 2023/0077573 | A1 | 3/2023 | Sakaizawa et al. |

FOREIGN PATENT DOCUMENTS

| | | | |
|---|---|---|---|
| JP | 2001-262278 | A | 9/2001 |
| JP | 2004-183023 | A | 7/2004 |
| JP | 2004-323949 | A | 11/2004 |
| JP | 2005-256049 | A | 9/2005 |
| JP | 2005-274401 | A | 10/2005 |
| JP | 2005-290449 | A | 10/2005 |
| JP | 2011-202253 | A | 10/2011 |
| JP | 2012-92360 | A | 5/2012 |
| JP | 2017-88915 | A | 5/2017 |
| JP | 6788852 | B1 | 11/2020 |
| WO | WO 2017/056618 | A1 | 4/2017 |
| WO | WO 2021/172381 | A1 | 9/2021 |
| WO | WO 2022/014307 | A1 | 1/2022 |

* cited by examiner

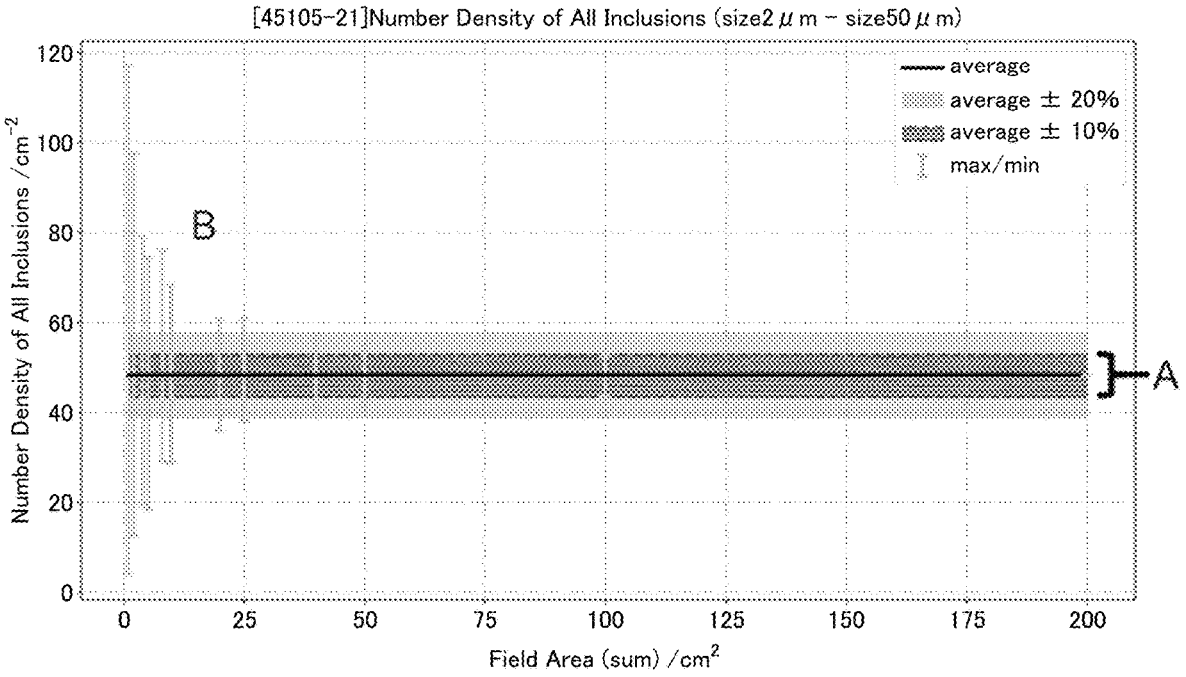
[45105-21]Number Density of All Inclusions (size2 μm – size50 μm)
Number Density of All Inclusions /cm$^{-2}$
Field Area (sum) /cm$^2$
average
average ± 20%
average ± 10%
max/min
A
B
0
20
40
60
80
100
120
0
25
50
75
100
125
150
175
200

FERROUS ALLOY FOIL, MANUFACTURING METHOD THEREFOR, AND COMPONENT USING SAME

FIELD

The present invention relates to ferrous alloy foil and a manufacturing method thereof and to components using the ferrous alloy foil. For example, it can be suitably used for metal masks, hard disk drive suspensions, and other electronic device components and to components for manufacturing electronic devices.

BACKGROUND

Along with the reduction of size and higher density mounting of electronic equipment, reduction of size and lightening of weight of the electronic components forming the electronic equipment are being sought.

In many cases, along with the reduction of size of electronic components, higher precision has become necessary. For example, photoetching is a technique made much use of for high precision processing of electronic components. As examples of higher precision of electronic components using this, the higher pixel density of OLEDs (organic light emitting diodes) due to the increasingly smaller size of the mask holes of the metal mask, the increasingly smaller size of the suspensions of hard disk drives (HDD), etc. can be mentioned. The metal masks used for these are manufactured by forming patterns on the surfaces of thin metal sheets by the photoresist method, then dissolving away parts of the metal sheets.

The mask holes of a metal mask have to correspond 1:1 with the RGB of the pixels of the OLED manufactured, so the pitch intervals between mask holes become at least the same extent as the pixel density of the OLED. The diameters of the mask holes are made finer along with this.

Normally, the mask holes of a metal mask become frustoconical (cross-sections forming tapered shapes). To do this, the metal mask is manufactured by masking one surface side of the metal sheet for forming the mask by dry film to form small holes and the other surface side to form large holes and half etching from the respective surfaces down to about half of the sheet thickness.

In the metal sheet for manufacturing a metal mask, if there are inclusions difficult to be dissolved by the etching solution, sometime etching defects are caused. For example, if there are inclusions having a size of half or more of the thickness of the metal sheet at parts where the mask holes are formed, the metal parts around the inclusions are dissolved at the time of half etching from one side.

Further, the parts where the dry film is arranged at the surface at the opposite side are also dissolved and the dry film at the opposite side peels off. Further, at the time of half etching the metal sheet from the opposite side, the metal film at the parts where the dry film peeled off is also etched resulting in a state of irregularly shaped holes formed centered about the inclusions.

This is one example, but the etching defects due to such inclusions become more marked the greater the pixel density of the OLED manufactured. The reason why is that, as explained above, a metal mask is formed by etching a metal sheet having a thickness of the same extent as the pitch interval corresponding to the pixel density of the OLED manufactured. Therefore, in the case of an OLED with a pixel density of 800 to 1000 PPI, a need arises to make the sheet thickness of the metal mask thinner from the current 20.00 to 30.00 μm to 12.00 to 15.00 μm. For this reason, there is a need for limiting the size of the inclusions to less than 10.00 μm.

The inclusions are mainly alumina ($Al_2O_3$), magnesium-aluminum spinel ($MgO{\cdot}Al_2O_3$), and other hard inclusions and silica ($SiO_2$), CaO, and other soft inclusions. Hard inclusions are high in interfacial energy and easily aggregate and, further, easily becomes larger in size after aggregation. Furthermore, hard inclusions are hard to break down in hot rolling and cold rolling and as a result large sized inclusion particles end up remaining. Therefore, to reduce etching defects accompanying higher precision working, it is important to reduce the size of inclusions contained in the metal sheet and reduce the number of particles.

To manufacture such a metal mask, in PTLs 1 and 2, it has been proposed to use an Invar alloy.

PTL 1 discloses a manufacturing method of a metal mask for OLED use with a sheet thickness of 100.00 μm or so comprised of vacuum melting, forging, hot rolling, cold rolling, and process annealing an Fe—Ni-based alloy in that order.

PTL 2 discloses to reduce the oxygen concentration of a melt by raising the cleanliness of the melt by vacuum induction melting etc., then casting an ingot to thereby prevent etching defects of a metal mask material.

However, continuous casting and vacuum melting include the steps of pouring a melted alloy (below, referred to as the "melt") from a tundish or melting furnace to a fixed shape container and cooling the container to produce a steel slab. It take time for the steel slab manufactured by the continuous casting and vacuum melting to completely solidify. For this reason, the steel slab manufactured by the continuous casting and vacuum melting is solidified from the outside while its center remains in a molten state, so inclusions easily segregate and solidify inside the steel slab.

Furthermore, in the case of continuous casting, even if removing the molten slag inside the tundish, the alumina and spinel remaining inside the melt are high in interfacial energy, so easily cluster and form coarse inclusions during cooling of the melt.

PTLs 3 and 4 disclose manufacturing methods of Fe—Ni alloy sheets for etching use estimating the size of the largest nonmetallic inclusions of Fe—Ni alloy slabs and enabling clarification the history of quality of the finally obtained rolled sheets, coils, etc. However, in PTLs 3 and 4, the ingots of the Fe—Ni alloy are manufactured by being cast by the usual ingot casting method or being cast by continuous casting. For this reason, it takes time until the steel slabs manufactured by methods the disclosed in PTLs 3 and 4 are completely solidified, so inclusions easily segregate and solidify inside the steel slabs.

PTL 5 discloses to use a vacuum induction melting furnace to fabricate a Fe-31% Ni-5% Co Super Invar-based alloy steel ingot, then heat it to 1100° C. for solid solution forming treatment, forge and hot roll it to obtain a sheet material and treat this at 800 to 900° C. for precipitation of niobium nitride, then repeatedly cold roll and anneal it to fabricate a thickness 0.1 mm cold rolled material. However, in the step of fabricating a steel ingot by the vacuum induction melting furnace and the subsequent solid solution forming step, as explained above, time is taken until solidification, so inclusions easily segregate and solidify inside the steel slab.

PTL 6 discloses a stainless steel sheet suitable for a member for an HDD (hard disk drive) or a thin film silicon solar cell substrate or other precision equipment part. The presence of fine pits distributed at the surface of a stainless steel sheet greatly affects the cleanliness of stainless steel sheet. It discloses that these fine pits are due to inclusions and carbide particles dropping off in the rolling step. Furthermore, PTL 6 describes that MgO—$Al_2O_3$-based inclusions are small in deformation ability in a cold rolling step, so voids or cavities are easily formed at the metal/inclusion interface and easily form starting points of micropits and cracking. As opposed to this, it is disclosed that nonmetallic inclusions mainly comprised of Mn(O,S)—$SiO_2$ are formed and nonmetallic inclusions are rendered harmless by adjusting the MgO and $Al_2O_3$ to a predetermined concentration or less.

PTL 7 discloses a metal sheet of an Fe—Ni-based alloy sheet for vapor deposition mask use wherein the number of 1 μm or more particles per 1 $mm^3$ is made 3000 or less, the number of 3 μm or more particles is made 50 or less, and, furthermore, the number ratio of 1 to 3 μm particles to the total number of 1 μm or more particles becomes 70% or more. However, the manufacturing method of the metal sheet disclosed in PTL 7 is predicated on inclusions floating up during solidification at the time of ingot production and does not consider segregation occurring the usual solidification process (in particular segregation to the center part of the ingot), so this cannot be applied to actual manufacture of metal sheets. For this reason, substantially, PTL 7 only discloses selection criteria which a person skilled in the art would naturally apply of selecting metal sheets with few coarse inclusions for use for a metal sheet for a vapor deposition mask.

CITATIONS LIST

Patent Literature

[PTL 1] Japanese Unexamined Patent Publication No. 2004-183023
[PTL 2] Japanese Unexamined Patent Publication No. 2017-88915
[PTL 3] Japanese Unexamined Patent Publication No. 2005-256049
[PTL 4] Japanese Unexamined Patent Publication No. 2005-274401
[PTL 5] Japanese Unexamined Patent Publication No. 2001-262278
[PTL 6] Japanese Unexamined Patent Publication No. 2011-202253
[PTL 7] Japanese Patent No. 6788852

SUMMARY

Technical Problem

As explained above, etching defects due to inclusions become more marked the higher the required precision of electronic components or the smaller the size. For example, they become more marked the larger the pixel density of the OLEDs manufactured and the smaller the size of the HDD use suspension.

The inventors proceeded to intensively research the relationship between the size of inclusions and etching defects of the metal mask material. As a result, they discovered that if the sheet thickness of the metal mask material is an extremely thin one of about 10.00 μm, etching defects of the metal mask material are decreased if decreasing inclusions larger than 5.00 μm.

Further, they discovered that pinholes are decreased if decreasing inclusions with a particle size larger than 5.00 μm contained in the metal mask material.

Therefore, the present invention has as its technical issue to reduce the number of coarse inclusions with particle sizes more than 5.00 μm in ultrathin ferrous alloy foil with a thickness of 10.00 μm or more and has as its object the provision of ferrous alloy foil decreased in coarse inclusions, a manufacturing method thereof, and a component using the same. Below, unless particularly indicated otherwise, inclusions with a particle size of more than 5.00 μm will be referred to as "coarse inclusions".

Solution to Problem

The inventors took note of $Al_2O_3$, MgO, $SiO_2$, CaO, Mn(O, S), and CrS as the basic constituents of inclusions. They discovered that inclusions comprised of, among these, at least one of $SiO_2$, CaO, Mn(O, S), and CrS are resistant to clustering and, further, are low in melting point and soft, so are stretched or crushed in a hot rolling step or cold rolling step whereby the coarse inclusions are decreased. ($SiO_2$, CaO, Mn(O, S), and CrS are sometimes referred to as "soft inclusions".)

On the other hand, alumina ($Al_2O_3$), magnesium-aluminum spinel ($MgO \cdot Al_2O_3$. Below, sometimes referred too as "spinel"), or other inclusions are high in interfacial energy and segregate and aggregate during solidification, so the size after aggregation easily becomes larger. Furthermore, alumina and spinel inclusions are hard, so the inclusions are hard to crush in hot rolling and cold rolling and, as a result, end up remaining as large sized inclusion particles. (Sometimes alumina and magnesium-aluminum spinel will be referred to as "hard inclusions")

Therefore, the inventors discovered that by reducing the ratio of alumina or spinel contained in inclusions, reevaluating the manufacturing conditions of ferrous alloy foil, in particular the rolling conditions, decreasing the number of coarse alumina or spinel inclusion, and making soft inclusions finely disperse, it is possible to obtain ferrous alloy foil decreased in coarse inclusions.

The present invention was made based on the above findings and has as its gist the following:

(1) A ferrous alloy foil having a composition containing, by mass %,
C: 0.150% or less,
Si: 2.00% or less,
Mn: 10.00% or less,
Ni: 2.00 to 50.00%,
Cr: 19.00% or less,
N: 0.20% or less,
Al: 0.030% or less,
Co: 5.00% or less,
Mg: 0.0005% or less,
Ca: 0.0005% or less,
Ti: 0.01% or less,
P: 0.035% or less, and
S: 0.0300% or less and
having a balance of Fe and impurities,
wherein the ferrous alloy foil has $Al_2O_3$: 30 mass % or less and MgO: 15 mass % or less with respect to a total mass of inclusions of a particle size of 2.00 μm or more,
a number ratio of inclusions of a particle size of 5.00 μm or less among the inclusions of a particle size of 2.00 μm or more is 80.00% or more, and
a sheet thickness is 10.00 to 30.00 μm.

(2) The ferrous alloy foil according to (1), wherein in the ferrous alloy foil, by mass %, Ni: 30.00 to 50.00%.

(3) The ferrous alloy foil according to (1) or (2), wherein in the ferrous alloy foil, by mass %, at least one of C: 0.050% or less, Ca: 0.0005% or less, Mn: 0.30% or less, Si: 0.30% or less, Mg: 0.0005% or less, and Al: 0.030% or less is satisfied.

(4) The ferrous alloy foil according to any one of (1) to (3), wherein a density of inclusions of a particle size of more than 5.00 μm is 15/cm$^2$ or less.

(5) The ferrous alloy foil according to any one of (1) to (4), wherein at the surface of the ferrous alloy foil, a density of pinholes of a diameter of 20 μm or more at the surface is 5/1000 m$^2$ or less.

(6) The ferrous alloy foil according to (1), wherein the ferrous alloy foil is comprised of austenitic stainless steel containing, by mass %, C: 0.150% or less, Si: 0.1 to 2.00%, Mn: 0.10 to 1.20%, S: 0.007% or less, Ni: 2.00 to 15.00%, Cr: 15.00 to 19.00%, N: 0.20% or less, and Al: 0.010% or less and having a balance of Fe and impurities, where a density of pinholes of a diameter of 20 μm or more at the surface is 5/1000 m$^2$ or less, and a 0.2% yield strength is 700 MPa or more.

(7) The ferrous alloy foil according to (6), wherein the inclusions of 2.00 μm or more are present at the surface by an area ratio of 1 to 100 ppm.

(8) A metal mask material comprised of the ferrous alloy foil according to any one of (1) to (7).

(9) A metal mask comprised of the ferrous alloy foil according to any one of (1) to (7).

(10) A component having the ferrous alloy foil according to any one of (1) to (7).

(11) A hard disk drive suspension comprised of a ferrous alloy foil according to any one of (1) to (7).

(12) An electronic device encapsulating member used by a component according to (10).

(13) A manufacturing method of ferrous alloy foil comprising a hot rolling step of rolling a steel slab comprised of a composition according to any one of (1) to (3) and (6) and a cold rolling step, including finish rolling, of rolling the hot rolled sheet which has been hot rolled, wherein a reduction rate in the cold rolling is 99.0% or more, and a reduction rate in each pass of the finish rolling (below sometimes referred to as simply a pass) is 1 to 18%.

Advantageous Effects of Invention

According to the present invention, it is possible to provide a ferrous alloy foil reduced in coarse inclusions and resistant to occurrence of defects at the time of rolling work or etching work. Furthermore, if applied to metal masks or suspensions for hard disks, etching defects can be remarkably reduced and high precision working becomes possible with a high yield. Furthermore, due to such high precision working, smaller sized electronic components can be obtained.

BRIEF DESCRIPTION OF DRAWINGS

FIG. 1 is a view showing one example for verifying an appropriateness of an evaluation area of inclusions at an alloy foil surface and a measurement area and variations in a number density of inclusions with respect to the same.

DESCRIPTION OF EMBODIMENTS

Below, the ferrous alloy foil according to the present invention will be explained in detail. Unless particularly indicated otherwise, the "%" relating to the constituents show the mass % in the steel. If the lower limit is not particularly prescribed, non-inclusion (0%) is also included

[Steel Composition]

The ferrous alloy foil of the present invention has a composition comprising, by mass %, C: 0.150% or less, Si: 2.00% or less, Mn: 10.00% or less, Ni: 2.00 to 50.00%, Cr: 19.00% or less, N: 0.20% or less, Al: 0.030% or less, Co: 5.00% or less, Mg: 0.0005% or less, Ca: 0.0005% or less, Ti: 0.01% or less, P: 0.035% or less, S: 0.0300% or less, and a balance of Fe and impurities.

Ni has the effect of improvement of the corrosion resistance and improvement of the workability and furthermore is a major element for adjusting the thermal expansion coefficient of the alloy. From the viewpoint of improving the corrosion resistance, the Ni content may be made 2.00% or more. Preferably, the Ni content may be made 5.00% or more, 10.00% or more, 15.00% or more, 2.00% or more, 25.00% or more. Furthermore, from the viewpoint of suppressing thermal expansion, the Ni content may preferably be made 30.00% or more, 31.00% or more, 32.00% or more, 34.00% or more, or 35.00% or more.

However, Ni is an expensive element. If the content is too high, after hot rolling or after hot forging, bainite structures easily form in the steel. Therefore, the Ni content is preferably 50.00% or less, 45.00% or less, 40.00% or less, 38.00% or less, or 37.00% or less.

Cr is an alloy constituent necessary for improvement of the corrosion resistance. However, if Cr is excessively contained, the steel material becomes hardened and the workability deteriorates, so the Cr content may be made 19.00% or less. The lower limit of the Cr content is not particularly prescribed and may be 0%. On the other hand, if the Cr content is 15.00% or more, the effect of Cr addition becomes remarkable, so preferably the content may be made 15.00% or more.

Co is a constituent which, if increased in amount of addition in relation to the amount of Ni, can make the thermal expansion coefficient of the alloy fall much more. Co need not be contained, but if contained, may be contained in 0.01% or more, 0.02% or more, or 0.05% or more. On the other hand, it is an extremely high priced element, so the upper limit of the Co content may be made 5.00%, preferably is 4.00% or less or 3.00% or less.

C (carbon) need not be contained, but increases the strength of the metal foil of the metal mask material etc., so may be contained. If containing C, the content may be made 0.001% or more, 0.003% or more, 0.005% or more, 0.010% or more, or 0.020% or more. However, if C is excessively contained, the thermal expansion coefficient becomes larger and Cr-based inclusions precipitating at the crystal grain boundaries (Cr carbides) increase and become causes of formation of pinholes. Therefore, the C content may be made 0.150% or less, preferably is 0.100% or less or 0.050% or less.

Ca dissolves in sulfides to cause the sulfides to finely disperse and makes the sulfides spherical in shape. Ca need not be contained, but if contained, the Ca content may be made 0.00010% or more or 0.0002% or more. On the other hand, if containing Ca in a large amount, the Ca not dissolving in the sulfides forms coarse oxides and is liable to cause etching defects. Therefore, the amount of Ca may be 0.0005% or less, preferably is 0.0004% or less.

Mn is proactively used as a deoxidizer in place of Mg and Al for avoiding formation of spinel. However, if the Mn content is too great, it segregates at the grain boundaries and aids grain boundary fracture whereby the hydrogen embrittlement resistance becomes lower. Therefore, the Mn content may be made 10.00% or less, Preferably, it may be made 5.00% or less, 2.00% or less, 1.50% or less, 1.20% or less, 1.00% or less, 0.80% or less, 0.60% or less, 0.50% or less, 0.40% or less, or 0.30% or less.

Mn need not be contained. However, if the Mn content is too small, it becomes difficult to adjust the inclusions to a Mn(O,S)—$SiO_2$ based composition. For this reason, the Mn content may preferably be made 0.01% or more, 0.03% or more, 0.05% or more, or 0.10% or more.

Here, Mn(O,S) indicates MnO alone, MnS alone, and composite inclusions of MnO and MnS. The ratio of O and S is not constant. It means composite inclusions of oxides and sulfides.

Si is proactively used as a deoxidizer in place of Mg and Al for avoiding formation of spinel. However, Si makes the thermal expansion coefficient of the alloy increase. The metal mask material is sometimes used in a 200° C. or so temperature environment so that the organic EL light emitting material discharged from the vapor deposition source can pass through the mask holes. Further, the deoxidation product MnO—$SiO_2$ forms glassified soft inclusions and is stretched and split during hot rolling to be broken down. For this reason, the hydrogen embrittlement resistance rises. On the other hand, if the Si content is more than 2.00%, the strength becomes too high resulting in hardening. When cold rolling to produce thin sheet, a large number of rolling passes are required for rolling the steel down to a predetermined sheet thickness and the productivity greatly drops. For this reason, Si is 2.00% or less, more preferably 1.00% or less or 0.50% or less, more preferably 0.30% or less.

Si need not be contained. However, if too little, the deoxidation becomes insufficient, the concentration of $Cr_2O_3$ in the inclusions increases, and inclusions causing work cracking are easily formed. Therefore, the Si content may be preferably 0.01% or more, 0.03% or more, 0.05% or more, or 0.10% or more.

Mg is used for deoxidation of steel. However, if the Mg content is more than 0.0005%, coarse inclusions are liable to be formed. Further, to avoid formation of spinel, the lower the content of Mg, the better, so it need not be contained. Therefore, the Mg content may be 0.0005% or less, preferably is 0.0003% or less, 0.0002% or less, or 0.0001% or less.

Al is also used for deoxidation of steel. However, if the Al content is more than 0.030%, coarse inclusions are liable to be formed. Further, to avoid formation of spinel, the lower the content of Al the better. Therefore, the Al content may be 0.030% or less, preferably is 0.020% or less, 0.010% or less, or 0.005% or less.

P and S are elements which bond with Mn and other alloy elements in a ferrous alloy, so the contents are preferably small, therefore they need not be contained. Therefore, the P content is 0.035% or less, preferably is 0.010% or less, 0.007% or less, or 0.005% or less, while the S content is 0.0300% or less, preferably is 0.0100% or less, 0.0070% or less, or 0.0050% or less.

Ti makes the thermal expansion coefficient of the alloy increase, so is preferably small in amount. Therefore, Ti need not be contained, but its content may be made 0.01% or less.

N is a solution strengthening element similar to C. If N is included in a large amount, the 0.2% yield strength rises, but the steel material hardens and the manufacturability remarkably deteriorates. For this reason, N need not be contained. The upper limit of the N content may be made 0.20%. Preferably, the content is made 0.10% or less.

The balance of the above steel composition is comprised of Fe and unavoidable impurities. Here, the "unavoidable impurities" mean constituents which enter due to various factors in the production process such as the ore, scrap, or other raw materials when industrially producing steel and which are allowed in a range not detrimentally affecting the present invention.

[Inclusions]

The fewer the inclusions the better. Not being present at all is ideal. However, they enter in the production process and are formed from steel constituents, so complete elimination is not easy. As explained above, if used as a material of a metal mask etc., inclusions of a size of about half of the sheet thickness become causes of etching defects and are therefore harmful. Furthermore, it was learned that coarse inclusions at the surface drop off during rolling and easily become causes of pinholes and surface pits. Therefore, it is important to greatly reduce large particle size inclusions, for example, in the case of ultrathin alloy foil with a sheet thickness of 10 μm, inclusions with a circle equivalent particle size of 5 μm or more.

The inventors focused on $Al_2O_3$, MgO, $SiO_2$, CaO, Mn(O, S), and CrS as the basic constituents of the inclusions. Among these, it was learned that the soft inclusions of $SiO_2$, CaO, Mn(O, S), and CrS are resistant to clustering, low in melting point, and soft, so are stretched or crushed by rolling and coarsening is suppressed. On the other hand, alumina and magnesium-aluminum spinel and other hard inclusions are high in interfacial energy and easily segregate and aggregate in the solidification process, so the size after aggregation easily becomes larger. Furthermore, it was learned that alumina and spinel inclusions are hard, so are hard to stretch or crush in rolling and as a result end up remaining as large sized inclusion particles.

From these findings, it is believed that it is important to suppress the formation of soft inclusions and, furthermore, break down any soft inclusions formed by adjusting the rolling conditions (for example, reduction rate). On the other hand, hard inclusions are hard to break down by rolling, so it is believed that it is important to not allow the formation of hard inclusions and, further, not allow their entry, for example, not allow aggregation (not allow coarsening) even if formed or entering.

First, to not allow the formation of inclusions, both soft and hard, and to secure the mechanical strength as an alloy foil, it is possible to use the steel constituents explained above.

To not allow the entry of inclusions, reevaluation of the process becomes important. For example, it is possible to reevaluate the refractories at the time of melt treatment and use refractories with little Al, Mg, etc.

Further, one of the causes of aggregation of inclusions is the segregation and aggregation when solidifying from a melt. It is not easy to avoid segregation at the time of solidification, but stirring the melt so that it does not aggregate as much as possible and other methods may be considered. Furthermore, ingots may be produced by a process not using a process of solidification from a melt, for example, HIP (hot isostatic pressing) etc. The production process will be explained later.

The inclusions contained in the ferrous alloy foil of one aspect of the present invention cover inclusions of a particle size (circle equivalent size) of 2.00 μm or more (below, unless otherwise indicated, sometimes simply referred to as "inclusions") due to reasons of measurement. Coarse inclusions of a particle size more than 5.00 μm are harmful and should be reduced as much as possible. On the other hand, inclusions of a particle size of 2.00 to 5.00 μm are preferably decreased, but they are not directly harmful.

In one aspect of the present invention, the number of inclusions of a particle size of 2.00 to 5.00 μm may be 80.00% or more in terms of the number ratio with respect to the total number of inclusions of a particle size of 2.00 μm or more. Preferably, the ratio is 85.00% or more, 90.00% or more, 95.00% or more, 97.00% or more, 98.00% or more, 99.00% or more, or 100%.

Further, the hard inclusions such as alumina and spinel easily become coarse particles, so should be reduced as much as possible. For this reason, $Al_2O_3$ may be made 30 mass % or less with respect to the total mass of inclusions of a particle size of 2.00 μm or more and MgO may be made 15 mass % or less. These hard inclusions are preferably small in number, so the ratio of $Al_2O_3$ is preferably 25% or less, 20% or less, 15% or less, 10% or less, 5% or less, 3% or less, or 1% or less. Similarly, the ratio of MgO is preferably 10% or less, 8% or less, 6% or less, 5% or less, 4% or less, 3% or less, 2% or less, or 1% or less.

The size of the inclusions is measured as follows: A scanning type electron microscope (SEM) is used to examine the inclusions at the metal foil surface. As the SEM, for example a JSM-IT500HR made by JEOL may be used. One example of the settings of the SEM is shown below:

Detector: backscattered electron detector BED-C
Observation power: 80×
Acceleration voltage: 20.0 kV
Working distance (WD): 10.0 mm
Irradiation current: 80%

Further, images acquired by the SEM were analyzed by inclusion automatic analysis software to detect the inclusions. The composition of the inclusions was analyzed by an energy dispersion type X-ray spectrograph (below, EDS apparatus). As the inclusions automatic analysis software, for example, the particle analysis mode of Aztec made by Oxford may be used. As the EDS apparatus, for example, ULTIM MAX 65 made by Oxford may be used.

In the process of discrimination of inclusions by the inclusion automatic analysis software, first the SEM images used in the inclusion automatic analysis software are acquired. Next, if particles of a circle equivalent diameter (equal area circle equivalent diameter) of 2.00 μm or more are detected by the inclusion automatic analysis software from the images acquired by the SEM and at least one or more of the elements of Al, Mg, Si, Ca, Mn, and S are detected by EDS, these are discriminated as inclusions. The images finished being analyzed by EDS are joined together on software and output as a single image. At that time, the circle equivalent diameter and elemental composition of the inclusions discriminated by the inclusion automatic analysis software are also acquired. The above procedure for discrimination of inclusions is repeatedly performed to measure up to the set area. For example, for the measurement area of the images, it is possible to perform the measurement for 10 fields, one field being the unit of measurement of 10 $cm^2$, and make the total 100 $cm^2$ as the evaluation area. Note that the diameter of a circle having the same area as the measured area of an inclusion is made the circle equivalent (circle equivalent diameter) and is referred to as the "particle size".

Regarding the composition of the inclusions, the inclusions discriminated by the inclusion automatic analysis software are calculated in the following way. First, the mass %'s of the elements Al, Mg, Si, Ca, Mn, Cr, and S obtained by EDS analysis area are divided by the respective atomic weights to find the physical masses of only the elements. Next, the above seven types of elements were rendered states of oxides or sulfides of the basic constituents of the inclusions. In the inclusions, Al, Mg, Si, and Ca are mainly present as oxides.

Mn and Cr are also mainly present as sulfides and Mn is also present as the oxide MnO. S is sometimes also present as the chrome sulfide CrS in addition to the above-mentioned sulfide MnS. If the apparent amount of substance of S is greater than the apparent amount of substance of Mn, the same amount of MnS as the apparent amount of substance of Mn is present. At this time, CrS is present in an amount of substance of the apparent amount of substance of S minus the apparent amount of substance of Mn. If the apparent amount of substance of S is smaller than the apparent amount of substance of Mn, the same amount of MnS as the apparent amount of substance of S is present. At this time, MnO is present in an amount of substance of the apparent amount of substance of Mn minus the apparent amount of substance of S. If the apparent amount of substance of Mn and the apparent amount of substance of S are completely the same amounts, the same amount of MnS as the amounts of substance of Mn and S is present.

To render the basic constituents of the inclusions the states of oxides or sulfides, the amount of substance of the element O (oxygen) or S corresponding to the apparent amounts of substance of the elements are imparted based on the respective stoichiometric ratios of Al:O=2:3, Mg:O=1:1, Si:O=1:2, Ca:O=1:1, Mn:O=1:1, Mn:S=1:1, S:Cr=1:1, then are multiplied with the respective molecular weights to calculate the masses converted to oxides etc. The respective masses converted to oxides etc. found are divided by the total of the seven mass % converted to oxides etc. to find the mass % converted to oxides etc. of $Al_2O_3$, MgO, $SiO_2$, CaO, MnO, MnS, and CrS (below, sometimes referred to as the "oxides etc.") The converted mass % of the seven oxides etc. with respect to the areas of the inclusions found by the inclusion automatic analysis software are respectively cumulatively added to find the inclusion areas ($\mu m^2$) of $Al_2O_3$, MgO, $SiO_2$, CaO, MnO, MnS, and CrS.

Next, the respective inclusion areas are found for all inclusions discriminated by the inclusion automatic analysis software and the inclusion areas are totaled up for each of the several oxides or sulfides to obtain the total area of $Al_2O_3$, the total area of MgO, the total area of $SiO_2$, the total area of CaO, the total area of MnO, the total area of MnS, and the total area of CrS. The sum of the seven total areas is made the total area of all inclusions. The total area of the oxides etc. is divided by the total area of the full inclusions to calculate the ratio of composition (mass %) of the inclusions.

[Regarding Area Ratio]

Regarding the area ratio of the inclusions, the total of the area of each of the oxides etc. or the total area of all inclusions is divided by the evaluation area and made the area ratio of each oxide etc. or the area ratio of all inclusions.

[Regarding Evaluation Area]

Note that, if the inclusions are unevenly present in the metal foil, it is believed that the state of presence of inclusions could change depending on the location examined by the SEM. Therefore, the following method was used to verify the appropriateness of the evaluation area. First, 200 $cm^2$ was measured by a SEM and inclusion automatic analysis software was used to discriminate the inclusions. The measurement area was equally divided into 200 squares in a lattice form. At this time, one square had a square shape of 1 cm per side. The area made 1 $cm^2$. Next, to increase the statistical number, "k" number of squares are randomly selected from the 200 squares, the number density of all inclusions when virtually measuring 1 $cm^2 \times k$ number=$kcm^2$ was derived, and this was repeated 1000 times to obtain a number density at the time of a measurement area of $kcm^2$ of 1000. Here, the number density of all inclusions was derived by dividing the number of all inclusions observed in the measurement area $kcm^2$ by the measurement area. "k" was made 1, 2, 4, 5, 8, 10, 20, 25, 40, 50, 100, and 200. Next, the number density of all inclusions at k=200 $cm^2$ was expressed by the average of FIG. 1 (solid line). The maximum value and minimum value of the obtained 1000 number density were shown by the error bar of FIG. 1. From FIG. 1, it was verified that if an evaluation area of 100 $cm^2$, the values were within the average±10%. From the results, the preferable evaluation area is considered to be 100 $cm^2$ and the evaluation area was determined as 100 $cm^2$.

The ferrous alloy foil according to the present invention is greatly decreased in number ratio of spinel-based inclusions, so coarse inclusions are not easily present. If Mn and Si are mainly used as deoxidizers, the number density of MnO—$SiO_2$-based inclusions becomes greater. This is because MnO—$SiO_2$-based inclusions are resistant to clustering and further are low in melting point and soft, so are easily stretched and crushed in the hot rolling step or cold rolling step and do not easily remain as coarse inclusions.

Further, the number density of inclusions of a particle size of more than 5.00 μm can be made 15/$cm^2$ or less. For this reason, inclusions of a size causing etching defects are reduced. The fewer the coarse inclusions of a particle size of more than 5.00 μm, the better. Preferably, they are 12/$cm^2$ or less, 10/$cm^2$ or less, 8/$cm^2$ or less, 6/$cm^2$ or less, or 5/$cm^2$ or less.

[Sheet Thickness]

As explained above, soft inclusions can be stretched and crushed to be broken down in the rolling process to reduce the coarse particles of 5.00 μm or more. For this reason, in rolling process of ferrous alloy foil, the reduction rate should be made higher. For this reason, while the sheet thickness of the ferrous alloy foil is not particularly limited, in the usual manufacturing process, the ingot has to be a certain extent of size, so the sheet thickness is preferably 30.00 μm or less. Preferably it is 27.50 μm or less, 25.00 μm or less, or 22.50 μm or less. On the other hand, if the sheet thickness is less than 10.00 μm, the handling at the time of etching work or the time of rolling work increases in difficulty, so wrinkles and other defects are liable to occur, therefore the sheet thickness should be made 10.00 μm or more.

[Pinholes]

If coarse inclusions are present on the surface of an alloy foil, they will drop off at the time of rolling etc. and form pits at those parts. If rolled in that state, the pits will become enlarged resulting in pinholes of a circle equivalent size of 20 μm (φ20 μm) or so or more. In the ferrous alloy foil according to the present invention, coarse inclusions are reduced, so pinholes due to coarse inclusions dropping off are also reduced and the number of pinholes of φ20 μm or more can be decreased to 5/1000 $m^2$ or less.

[Yield Strength]

If a composition prescribed above, the 0.2% yield strength can be made 700 MPa or more. If a 700 MPa or more 0.2% yield strength, it is possible to apply it to a metal mask etc. without kinks under usual usage conditions.

[Manufacturing Method of Ferrous Alloy Foil]

The ferrous alloy foil according to the present invention can for example be produced in the following way. The method shown below is an illustration. It is not intended that the invention be limited to this.

For example, raw materials adjusted to a predetermined composition are melted in vacuum in a $10^{-1}$ (Torr) or less vacuum atmosphere to obtain a melt of the targeted alloy composition. At this time, to deoxidize the melt, Mn and Si are added so that the contents of Mn and Si in the melt after slag removal become the respectively predetermined contents.

Next, Ar or $N_2$ gas or other inert gas is used to atomize (powderize) the melt by a gas atomizer. The melt temperature at the time of gas atomization is preferably made the melting point +50° C. to 200° C. in range so as to lower the viscosity of the melt. Further, the ratio of the gas flow rate ($m^3$/min)/melt flow rate (kg/min) at the time of gas atomization may be made 0.3 ($m^3$/kg) or more. If the ratio of the gas flow rate ($m^3$/min)/melt flow rate (kg/min) is less than 0.3 ($m^3$/kg), the cooling speed of the molten droplets becomes slower, so the liquid phase ratio of the liquid drops when striking the cast ingot surface becomes too high and the inclusions become coarser.

For this reason, the ratio of the gas flow rate and melt flow rate is made 0.3 ($m^3$/kg) or more, preferably 0.5 or more, 0.7 or more, 0.9 or more, 1.0 or more, or 1.5 or more, more preferably 2.0 or more. The upper limit of the ratio of the gas flow rate ($m^3$/min)/melt flow rate is not particularly prescribed, but if 5.0 ($m^3$/kg) or more, the cooling ability becomes saturated, so the upper limit may be made 5.0 ($m^3$/kg).

The alloy powder obtained by the atomization step is sintered by the hot press method or HIP method to produce an ingot. The method of sintering is not particularly limited. Suitable conditions may be set according to the ordinary hot press method etc.

Alloy powder becomes easier to sinter the smaller the particle size, but compared with large particle size alloy powder, the productivity becomes lower. On the other hand, the larger the particle size of the alloy powder becomes, the easier it is liable to become for impurities to enter from the furnace materials. For this reason, the alloy powder is made a particle size of 300 μm or less, preferably 250 μm or less, 200 μm or less, or 150 μm or less, more preferably 100 μm or less.

Due to the above atomization (powderizing) method, it is possible to keep down the contents of Al and Mg. Further, if using the sintering method of treatment in a solid phase, there will also be no entry of Al or Mg from refractories such as in the solidification method (casting method), so formation of coarse (for example, 5 μm or more) inclusions is suppressed. From these, in the end, $Al_2O_3$ and spinel-based inclusions themselves are decreased. In particular, formation of coarse inclusions of 5 μm or more can be remarkably suppressed.

Next, the produced alloy ingot is hot forged or cut or is ground down to produce a steel slab. This steel slab is rolled down to 3.0 mm to 200 mm thickness. This rolling may be hot rolling or cold rolling. The 3.0 mm to 200 mm thick rolled sheet is repeatedly rolled to form ferrous alloy foil.

The ingot may be annealed before or after the hot rolling, hot forging, or cold rolling. Further, the temperatures in the annealing step, hot forging step, and hot rolling step are temperatures of less than the melting point of the ferrous alloy of the present invention so as to prevent aggregation of inclusions, preferably the melting point of the ferrous alloy of the present invention minus 500° C. or more to the melting point of the ferrous alloy of the present invention minus 200° C. or less in range.

After the hot rolling or hot forging, cold rolling may be performed. In the middle of the cold rolling, process annealing may also be performed. Due to the rolling, the inclusions, in particular the soft inclusions, are stretched and crushed so the inclusions can be broken down. For breaking down the inclusions, cold rolling is more effective than hot rolling. Further, the thinner the sheet thickness, the more effective, so the total reduction rate of the cold rolling should be made 97.0% or more based on the sheet thickness after hot rolling (sheet thickness right before cold rolling). Preferably it may be made 98.0% or more, 99.0% or more, or 99.5% or more. Furthermore, with a higher reduction rate, a greater effect of breaking down the inclusions can be expected, so with the exception of the pass for reaching the targeted sheet thickness and the pass for correcting the shape, the reduction rate in each pass may be made 20.0% or more. By cold rolling by such a reduction rate, it is possible to break down and disperse the soft inclusions more by stretching and crushing.

On the other hand, in rolling after the sheet thickness becomes thinner to a certain extent and inclusions are broken down to a certain extent (finish rolling), it was learned that sometimes surface asperities are formed due to inclusions dropping off or pinholes are formed passing through the alloy foil. For this reason, in the finish rolling (multi-pass cold rolling) from 2 times to 3 times the final sheet thickness or 40 μm to the final sheet thickness (for example, 10 μm or 20 μm), to the final sheet thickness, it is possible to perform mild rolling lowering the reduction rate. For example, the reduction rate at each pass of the finish rolling may be made 1 to 18% and the cumulative reduction rate may be made 50% or more. Further, if the cumulative reduction rate of the finish rolling is less than 50.0%, sometimes the strength of the alloy foil is not manifested. The upper limit of the cumulative reduction rate of the finish rolling is not particularly prescribed, but it may be made 98.0% or less from the normal capacity of foil rolling machines.

That is, in cold rolling, the total reduction rate may be made 97.0% or more, while in the cold rolling before finish rolling, the reduction rate may be made 20% or more to break down the soft inclusions. In the finish rolling, mild rolling may be performed to keep inclusions from dropping off.

In general, the rolling from a sheet thickness of about 10 times the final sheet thickness down to the final sheet thickness (cold rolling) is called "foil rolling". This is sometimes differentiated from the cold rolling after hot rolling. In this case, the reduction rate may further be lowered in order from the cold rolling after hot rolling, the rolling up to before finish rolling in the foil rolling following that, and the final finish rolling. For example, the reduction rate in each pass may be made 40% or more for the cold rolling after hot rolling, 20% or more for the foil rolling before finish rolling, and less than 20% for the finish rolling in the foil rolling.

Here, the "reduction rate" is shown by the following formula when the sheet thickness before rolling is made t1 and the sheet thickness after the rolling is made t2.

$$\text{Reduction rate}=(t1-t2)/t1$$

For example, even if the finish rolling is multi-pass rolling, the cumulative reduction rate may be calculated using the sheet thickness before the finish rolling as t1 and the sheet thickness after the finish rolling as t2. For the reduction rate of each pass, the sheet thickness before each rolling pass may be made t1 and the sheet thickness after the rolling pass may be made t2.

Further, the unit rolling loads (kN/mm) of the individual passes in the finish rolling may be controlled to suitable regions. The "unit rolling load" is the load applied from the rolling rolls to the rolled material divided by the width of the rolled material. The preferable unit rolling load is 0.4 to 1.3 kN/mm. If the unit rolling load is less than 0.4 kN/mm, there is little work generated heat along with the rolling and the alloy film of the worked material falls in flexibility, so cracks form at the interface of the inclusions and alloy foil and more inclusions drop off. Further, if the unit rolling load is more than 1.3 kN/mm, the work generated heat increases, but the amount of plastic deformation of the alloy foil itself becomes larger, so cracks form at the interface with the inclusions and more inclusions drop off. For this reason, it is possible to control the unit rolling load instead of the reduction rate. Of course, the reduction rate and unit rolling load may also be controlled in combination.

Furthermore, after the finish rolling (final rolling), the foil may be annealed to remove stress.

Next, if used for a hard disk drive suspension, electronic device encapsulating member, or other component, a non-magnetic property is sought, so the foil may be made austenitic stainless steel with the following contents of constituents.

That is, it may be austenitic stainless steel containing, by mass %, C: 0.150% or less, Si: 0.1 to 2.00%, Mn: 0.10 to 1.20%, S: 0.007% or less, Ni: 2.00 to 15.00%, Cr: 15.00 to 19.00%, N: 0.20% or less, and Al: 0.010% or less and having a balance of Fe and impurities.

In this case as well, in the same way as the above explanation, it is possible to reduce the alumina- and spinel-based inclusions and possible to obtain alloy foil good in etchability and excellent in high precision workability.

EXAMPLES

Below, examples will be shown, but the present invention is not limited to the modes shown in the examples.

Example 1

In each of the Test Materials 1, 2, and 4, a vacuum induction melting furnace was used to prepare a melt of a ferrous alloy composition adjusted to the constituents shown in Table 1. This was powderized by gas atomization by $N_2$ gas. The melt temperature at the time of gas atomization was made the liquidus temperature+50° C. to the liquidus temperature+200° C. in range so as to lower the viscosity of the melt. Further, the ratio of the gas flow rate ($m^3$/min)/melt flow rate (kg/min) was adjusted to 1.0 to 3.0 ($m^3$/kg) at the time of gas atomization.

Next, the obtained alloy powder was sealed in a metal container to manufacture ingots of the Test Materials 1, 2, and 4 by the known HIP treatment method.

In Test Material 3 as well, a vacuum induction melting furnace was used to prepare a melt of a ferrous alloy composition adjusted to the constituents shown in Table 1, but after this the melt was transferred to a casting mold and allowed to solidify in the casting mold to produce an ingot. During this time, for the refractories of the tundish in which the melt is placed or the inside walls of the casting mold, refractories similar to those used in normal operations were used.

Each obtained ingot was hot forged to produce a steel slab with a cross-section of 80 mm×80 mm. The steel slab was hot rolled down to 3.0 mm thickness, then was cold rolled to obtain a steel sheet of a sheet thickness of 0.30 mm. The obtained steel sheet was rolled by so-called foil rolling (cold rolling, but called "foil rolling" to differentiate it from cold rolling after hot rolling) to produce alloy foil (steel foil) of a sheet thickness of 20 μm. At that time, with the exception of the pass for reaching the targeted sheet thickness and the pass for correcting the shape, the reduction rate in each pass at the cold rolling was made 40% to 50%. The reduction rate in each pass at the foil rolling until the sheet thickness of 40 to 50 μm was made 20 to 50% and the after that until the sheet thickness of 20 μm was made 1 to 18%. Note that suitable annealing was performed to remove the stress due to the cold rolling including the foil rolling.

TABLE 1

| Test Material | C | Si | Mn | Ni | Cr | N | Al | Co | Mg | Ca | Ti | P | S |
|---|---|---|---|---|---|---|---|---|---|---|---|---|---|
| | Composition (mass %) (balance of Fe and unavoidable impurities) | | | | | | | | | | | | |
| 1 | 0.013 | 0.06 | 0.20 | 36.10 | 0.01 | 0.02 | 0.002 | 0.01 | 0.0002 | 0.0001 | 0.001 | 0.002 | 0.0010 |
| 2 | 0.012 | 0.05 | 0.28 | 36.10 | 0.01 | 0.02 | 0.004 | 0.01 | 0.0005 | 0.0001 | 0.001 | 0.002 | 0.0005 |
| 3 | 0.010 | 0.06 | 0.30 | 36.00 | 0.01 | 0.02 | 0.007 | 0.01 | 0.0005 | 0.0001 | 0.001 | 0.002 | 0.0010 |
| 4 | 0.060 | 0.36 | 0.81 | 9.33 | 18.34 | 0.02 | 0.007 | 0.15 | 0.0001 | 0.0001 | 0.001 | 0.016 | 0.0020 |

The surfaces of the Test Materials 1 to 4 were examined for inclusions of the metal foil surfaces using an SEM (JSM-IT500HR made by JEOL). The settings of the SEM are shown below:

Detector: backscattered electron detector BED-C
Observation power: 80×
Acceleration voltage: 20.0 kV
Working distance (WD): 10.0 mm
Irradiation current: 80%

Further, images acquired by the SEM were analyzed by inclusion automatic analysis software (particle analysis mode of Aztec made by Oxford) to detect the inclusions. The composition of the inclusions was analyzed by an EDS apparatus (ULTIM MAX 65 made by Oxford).

In the process of discrimination of inclusions by the inclusion automatic analysis software, first the SEM images used in the inclusion automatic analysis software were acquired. Next, if particles of a circle equivalent diameter of 2.00 μm or more were detected by the inclusion automatic analysis software from the images acquired by the SEM and at least one or more of the elements of Al, Mg, Si, Ca, Mn, and S were detected by EDS, these were discriminated as inclusions. The images finished being analyzed by EDS were joined together on software and output as a single image. At that time, the particle size and elemental composition of the inclusions discriminated by the inclusion automatic analysis software were also acquired. The evaluation area was made 100 $cm^2$ and the circle equivalent diameter was made the particle size of the inclusions.

Regarding the composition of the inclusions, the inclusions differentiated by the inclusion automatic analysis software were analyzed for mass %'s of $Al_2O_3$, MgO, $SiO_2$, CaO, MnO, MnS, and CrS converted to oxides etc. The values were multiplied with the areas of the inclusions found by the inclusion automatic analysis software to find the inclusion areas $\mu m^2$ of the individual inclusions. Next, the processing was performed for all inclusions to find the area ratio for each oxide and this was divided by the area ratio of all inclusions to calculate the ratios of composition of the inclusions.

Regarding the respective metal mask materials, the results of evaluation of the inclusions per 100 $cm^2$ are shown in Table 2 and Table 3.

Each of the Test Materials 1 to 4 was cut to 100 mm×100 mm and was etched down to half of the sheet thickness (half etched) by a mask hole pattern envisioning a 1000 PPI OLED metal mask. Each of the Test Materials 1 to 4 after etching was evaluated for etching defects at 100 $cm^2$ at 10 locations for a total evaluation area of 1000 $cm^2$. Further, pinholes were evaluated for over the entire length of the metal foil of each of the Test Materials 1 to 4 (steel strip after rolling). The number of φ20 μm or more pinholes was measured. The results of evaluation of etching defects and evaluation of pinholes are described in Table 4.

TABLE 2

| Test Material | Number ratio of inclusions of 2 to 5 μm among inclusions of 2 μm or more (%) | Number density of inclusions of more than more than 5 μm (/$cm^2$) | Total area ratio of inclusions of 2 μm or more (ppm) |
|---|---|---|---|
| 1 | 92 | 1.7 | 6.1 |
| 2 | 98 | 0.2 | 34.5 |
| 3 | 74 | 19.4 | 12.9 |
| 4 | 96 | 1.9 | 5 |

TABLE 3

| Test Material | Composition of inclusions of particle size of 2 μm or more (mass %) | | | | | | | 0.2% yield strength |
|---|---|---|---|---|---|---|---|---|
| | $Al_2O_3$ | MgO | $SiO_2$ | CaO | MnO | MnS | CrS | (MPa) |
| 1 | 12.82 | 7.03 | 32.88 | 26.38 | 0.18 | 0.00 | 20.71 | 793 |
| 2 | 16.07 | 7.21 | 34.13 | 4.08 | 34.44 | 1.83 | 2.24 | 784 |
| 3 | 54.69 | 22.60 | 8.01 | 8.59 | 3.41 | 0.00 | 2.70 | 774 |
| 4 | 18.14 | 7.20 | 35.19 | 21.49 | 7.56 | 0.23 | 10.19 | 1229 |

TABLE 4

| Test Material | No. of etching defects (/400 $cm^2$) | No. of pinholes (/1000 $m^2$) | Remarks |
|---|---|---|---|
| 1 | 3 | 1 | Example |
| 2 | 5 | 2 | Example |
| 3 | 38 | 35 | Comparative example |
| 4 | 8 | 1 | Example |

The Test Material 2 is larger in the total area ratio (ppm) of the inclusions than the Test Material 3. However, as shown in Table 2, the Test Materials 1 and 2 have large ratios of inclusions with a particle size of 2.00 μm or more and 5.00 μm or less in range, that is, inclusions in a range of size not detrimentally affecting the etching. On the other hand, the Test Materials 1 and 2 have sizes which may detrimentally affect etching, that is, number densities of inclusions with particle sizes of more than 5.00 μm, much smaller than the Test Material 3.

Further, as shown in Table 3, the average composition of the inclusions of a particle size of 2.00 μm or more contained in the Test Material 3 contains $Al_2O_3$: more than 30 mass % and MgO: more than 15 mass %, so it is learned that large amounts of alumina or spinel are present as inclusions. As opposed to this, in the average composition of each of Test Materials 1, 2, and 4, the content of MgO was kept to a low 7.0% or so and the $Al_2O_3$ content was 20.0% or less, so it is learned that the alumina and spinel were greatly decreased in each of the Test Materials 1, 2, and 4.

As a result, as shown in Table 4, it is learned that the Test Materials 1, 2, and 4 are remarkably improved in etchability, number of pinholes, etc.

INDUSTRIAL APPLICABILITY

According to the present invention, it is possible to provide ferrous alloy foil decreased in coarse inclusions and resistant to occurrence of defects at the time of rolling work and etching work, so the ferrous alloy foil according to the present invention is useful for reducing the size and lightening the weight of electronic components. Furthermore, it can be suitably used for manufacture of high resolution OLEDs.

The invention claimed is:

1. A ferrous alloy foil comprising a composition containing, by mass %,
C: 0.150% or less,
Si: 2.00% or less,
Mn: 10.00% or less,
Ni: 2.00 to 50.00%,
Cr: 19.00% or less,
N: 0.20% or less,
Al: 0.030% or less,
Co: 5.00% or less,
Mg: 0.0005% or less,
Ca: 0.0005% or less,
Ti: 0.01% or less,
P: 0.035% or less, and
S: 0.0300% or less and
comprising a balance of Fe and impurities,
wherein the ferrous alloy foil has $Al_2O_3$: 30 mass % or less and MgO: 15 mass % or less with respect to a total mass of inclusions of a particle size of 2.00 μm or more,
a number ratio of inclusions of a particle size of 5.00 μm or less among the inclusions of a particle size of 2.00 μm or more is 80.00% or more, and
a sheet thickness is 10.00 to 30.00 μm.

2. The ferrous alloy foil according to claim 1, wherein, in the ferrous alloy foil, by mass %,
Ni: 30.00 to 50.00%.

3. The ferrous alloy foil according to claim 2, wherein, in the ferrous alloy foil, by mass %, at least one of
C: 0.050% or less,
Ca: 0.0005% or less,
Mn: 0.30% or less,
Si: 0.30% or less,
Mg: 0.0005% or less, and
Al: 0.030% or less
is satisfied.

4. The ferrous alloy foil according to claim 2, wherein a density of inclusions of a particle size of more than 5.00 μm is 15/$cm^2$ or less.

5. The ferrous alloy foil according to claim 2, wherein at the surface of the ferrous alloy foil, a density of pinholes of a diameter of 20 μm or more at the surface is 5/1000 $m^2$ or less.

6. The ferrous alloy foil according to claim 1, wherein, in the ferrous alloy foil, by mass %, at least one of
C: 0.050% or less,
Ca: 0.0005% or less,
Mn: 0.30% or less,
Si: 0.30% or less,
Mg: 0.0005% or less, and
Al: 0.030% or less
is satisfied.

7. The ferrous alloy foil according to claim 6, wherein a density of inclusions of a particle size of more than 5.00 μm is 15/$cm^2$ or less.

8. The ferrous alloy foil according to claim 6, wherein at the surface of the ferrous alloy foil, a density of pinholes of a diameter of 20 μm or more at the surface is 5/1000 $m^2$ or less.

9. The ferrous alloy foil according to claim 1, wherein a density of inclusions of a particle size of more than 5.00 μm is 15/$cm^2$ or less.

10. The ferrous alloy foil according to claim 9, wherein at the surface of the ferrous alloy foil, a density of pinholes of a diameter of 20 μm or more at the surface is 5/1000 $m^2$ or less.

11. The ferrous alloy foil according to claim 1, wherein at the surface of the ferrous alloy foil, a density of pinholes of a diameter of 20 μm or more at the surface is 5/1000 $m^2$ or less.

12. The ferrous alloy foil according to claim 1, wherein the ferrous alloy foil comprises austenitic stainless steel containing, by mass %,
C: 0.150% or less,
Si: 0.1 to 2.00%,
Mn: 0.10 to 1.20%,
S: 0.007% or less,
Ni: 2.00 to 15.00%,
Cr: 15.00 to 19.00%,
N: 0.20% or less, and
Al: 0.010% or less and
comprising a balance of Fe and impurities, where
a density of pinholes of a diameter of 20 μm or more at the surface is 5/1000 $m^2$ or less, and
a 0.2% yield strength is 700 MPa or more.

13. The ferrous alloy foil according to claim 12 wherein the inclusions of 2.00 μm or more are present at the surface by an area ratio of 1 to 100 ppm.

14. A metal mask material comprising the ferrous alloy foil according to claim 1.

15. A metal mask comprising the ferrous alloy foil according to claim 1.

16. A component comprising the ferrous alloy foil according to claim 1.

17. An electronic device encapsulating member comprising a component according to claim 16.

18. A hard disk drive suspension comprising a ferrous alloy foil according to claim 1.

19. A metal mask material comprising the ferrous alloy foil according to claim 2.

20. A manufacturing method of the ferrous alloy according to claim 1, comprising a hot rolling step of rolling a steel slab comprised of a composition according to claim 1, and a cold rolling step, including finish rolling, of rolling the hot rolled sheet which has been hot rolled, wherein a reduction rate in the cold rolling is 99.0% or more, and a reduction rate in each pass of the finish rolling is 1 to 18%.

* * * * *